US006794619B2

(12) United States Patent
Okubo

(10) Patent No.: US 6,794,619 B2
(45) Date of Patent: Sep. 21, 2004

(54) HEATER ENERGIZATION CONTROL CIRCUIT, HEATER ENERGIZATION CONTROL METHOD, AND IMAGE FORMING APPARATUS

(75) Inventor: Seino Okubo, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 119 days.

(21) Appl. No.: 10/345,898

(22) Filed: Jan. 16, 2003

(65) Prior Publication Data

US 2003/0136777 A1 Jul. 24, 2003

(30) Foreign Application Priority Data

Jan. 22, 2002 (JP) ..... 2002-013017

(51) Int. Cl.[7] ..... H05B 1/02

(52) U.S. Cl. ..... 219/492; 219/497; 219/216; 219/505; 323/908; 323/238; 399/69

(58) Field of Search ..... 219/492, 497, 219/501, 505, 216, 507; 323/236, 238, 901, 908; 399/33, 67, 69

(56) References Cited

U.S. PATENT DOCUMENTS 5,681,494 A * 10/1997 Suzuki et al. ..... 219/497
5,811,764 A * 9/1998 Hirst ..... 219/497
6,111,230 A * 8/2000 Cao et al. ..... 219/501

FOREIGN PATENT DOCUMENTS

| | | | |
|---|---|---|---|
| JP | 57080263 A * | 5/1982 | ..... H02M/1/18 |
| JP | 62-287314 | 12/1987 | |
| JP | 04-282588 | 10/1992 | |
| JP | 08-171305 | 7/1996 | |
| JP | 11-038821 | 2/1999 | |

* cited by examiner

*Primary Examiner*—Mark Paschall
(74) *Attorney, Agent, or Firm*—Hogan & Hartson, LLP

(57) ABSTRACT

A heater energization control circuit includes a heater, a power source that supplies an alternating current to the heater, a first capacitor that charges and discharges in accordance with a first time constant that is determined by an electrostatic capacity of the first capacitor and a resistance value of a first resistor, and a second capacitor that charges and discharges in accordance with a second time constant that is determined by an electrostatic capacity of the second capacitor and a resistance value of a second resistor. A controller determines an energization start timing to the heater in accordance with a size relationship between a voltage of the first capacitor and a voltage of the second capacitor, and starting to supply the alternating current to the heater by the power source for supplying under this timing.

27 Claims, 5 Drawing Sheets

HEATER ENERGIZATION CONTROL CIRCUIT, HEATER ENERGIZATION CONTROL METHOD, AND IMAGE FORMING APPARATUS

FIELD OF THE INVENTION

The present invention relates to an image forming apparatus such as a facsimile machine with a copying function (hereinafter referred to as a Multi-Function Peripheral (MFP)), which prints an image on a recording paper by using an electro-photographic method. In particular, the present invention relates to a heater energization control circuit for controlling an energization to a heater of a heat fuser that heats and fuses a toner image on a recording paper.

DESCRIPTION OF THE RELATED ART

Recently, the MFP, which prints an image on a recording paper by using an electro-photographic method, is being distributed widely throughout the market. The MFP generally includes a charger that charges a surface of a photoconductor uniformly, an exposure unit that forms an electrostatic latent image by exposing the surface of the photoconductor, a developer that forms a toner image by adhering toner supplied from a toner case to the electrostatic latent image, a transfer unit that transfers the toner image to a recording paper, and a heat fuser that heats and fuses the transferred toner image on the recording paper. A series of processes from charging, exposing, developing, and transferring, heat fusing is one unit of the recording process in the electro-photographic method.

The heat fuser includes a heater, and an alternating current is supplied to the heater. As a result, the toner image transferred to the recording paper is fused as a permanent image on a recording paper by heat that generates according to the alternating current supplied to the heater.

In general, the heater is dependent on temperature, and a resistance value of the heater changes greatly according to the temperature of the heater. In other words, when the temperature of the heater is low, the resistance value is extremely small comparing to a case when the temperature of the heater is high. As a result, when the temperature of the heater is low, an extremely large incoming electric current flows through the heater, a power supply voltage of the MFP decreases, and a flicker generates on the exposure unit. When the flicker generates, light intensity of the exposure unit becomes uneven, and there is a possibility for an image quality on the recording paper to deteriorate.

SUMMARY OF THE INVENTION

Therefore, an advantage of the present invention is to provide a heater energization control circuit and method, and an image forming apparatus that can prevent an incoming electric current flowing through a heater of a heat fuser.

The present invention relates to an image forming apparatus using an electro-photographic method. The image forming apparatus includes a heat fuser having a heater, and a supply unit for supplying an alternating current to the heater. In addition, the image forming apparatus includes a first capacitor that charges and discharges in accordance with a first time constant determined by an electrostatic capacitance of the first capacitor and a resistance value of a first resistor. The image forming apparatus also includes a second capacitor that charges and discharges in accordance with a second time constant determined by an electrostatic capacitance of the second capacitor and a resistance value of a second resistor. Furthermore, the image forming apparatus includes a determining unit for determining a time to start energization to the heater in accordance with a size relationship between the voltage of the first capacitor and the voltage of the second capacitor, and starting to supply the alternating current to the heater by the supply unit under this timing.

The determining unit starts the energization to the heater when the voltage of the second capacitor becomes larger than the voltage of the first capacitor.

The determining unit determines a period when energizing the heater in accordance with a size relationship between the voltage of the first capacitor and the voltage of the second capacitor.

The determining unit energizes the heater during a period when the voltage of the second capacitor is larger than the voltage of the first capacitor.

The determining unit is a comparator, and the voltage of the first capacitor is input to a non-inverting input terminal of the comparator, and the voltage of the second capacitor is input to an inverting input terminal.

Furthermore, the image forming apparatus of the present invention includes a zero crossing detecting unit for detecting a zero crossing of the alternating current, and discharges the first capacitor during a period of the zero crossing, and charges the first capacitor during a period of the non-zero crossing.

In addition, the image forming apparatus of the present invention includes a power switch, and charges the second capacitor when the power switched is ON, and discharges the second capacitor when the power switch is OFF.

At least one of the first capacitor and the second capacitor is a variable capacitor.

At least one of the first resistor and the second resistor is a variable resistor.

According to the above-described present invention, an incoming electric current flowing through the heater of the heat fuser can be prevented. In particular, the incoming electric current flowing through the heater can be suppressed as much as possible.

DETAILED DESCRIPTION OF THE PREFERRED EMBODIMENTS

An embodiment of the present invention, wherein an image forming apparatus is the Multi-Function Peripheral (MFP), will be described in accordance with accompanying drawings.

Figure 1:
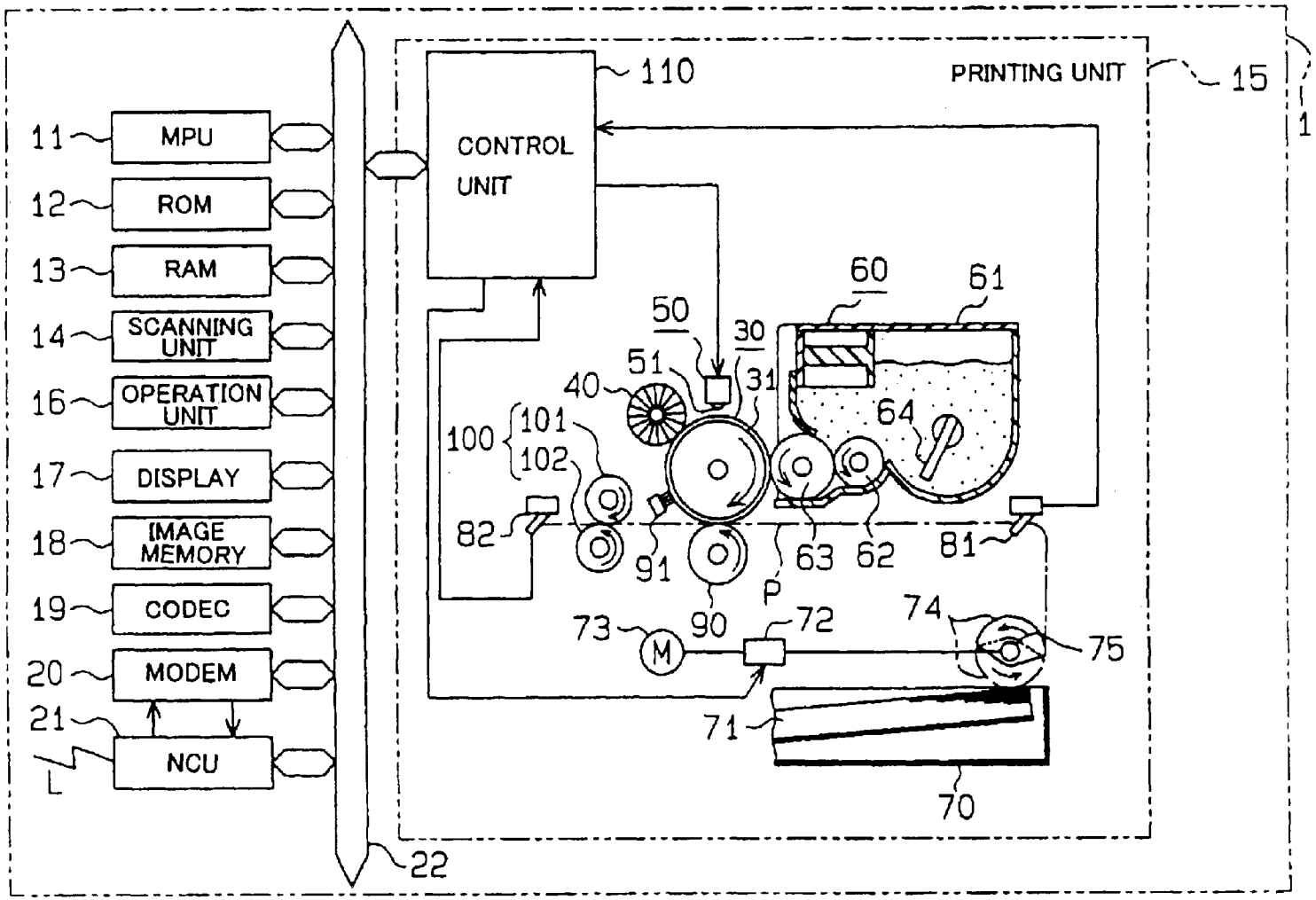
FIG. 1 is a block diagram showing a configuration of the MFP.

As shown in FIG. 1, MFP 1 includes a Micro Processor Unit (MPU) 11, a Read Only Memory (ROM) 12, a Random Access Memory (RAM) 13, a scanning unit 14, a printing unit 15, an operation unit 16, a display 17, an image memory 18, a codec 19, a modem 20, and a Network Control Unit (NCU) 21. Each of the units 11 through 21 is connected via a bus 22 respectively.

The MPU 11 controls each of the units that is included in the MFP 1. The ROM 12 stores programs for controlling the MFP 1. The RAM 13 temporarily stores various data relating to the MFP 1.

The scanning unit 14 scans an image of an original, and outputs an image data of a binary of black and white to the codec 19. The printing unit 15 is formed from an electrophotographic typed printer. The printing unit 15 prints a received image data or an image data of an original scanned by the scanning unit 14 on a recording paper 71. Further, details of the printing unit 15 will be described later on.

The operation unit 16 includes various operation keys, such as a start key for starting a scanning operation of the original, a stop key for stopping the operation of the MFP 1, a ten-key numeric pad (including "*", "#" keys) for inputting telephone numbers or the like, speed dial keys for registering speed dial numbers and calling from the speed dial numbers, and a communication/copy key for setting "communication (FAX)" operation or "copy" operation. The display 17 is a Liquid Crystal Display (LCD), and displays various information showing an operation status of the MFP 1.

The image memory 18 temporarily stores the received image data or an image data converted into a binary data by being scanned by the scanning unit 14 and compressed and encoded by the codec 19. The codec 19 encodes the image data scanned by the scanning unit 14 in accordance with an encoding method, such as Modified Huffman (MH), Modified Read (MR), Modified Modified Read (MMR), and Joint-Bi Level Image Group (JBIG). In addition, the codec 19 decodes image data fetched from the image memory 18.

The modem 20 modulates transmitting data and demodulates receiving data in accordance with any one of V.17, V.27ter, V.29 or the like based on a facsimile transmission control protocol following the International Telecommunications Union (ITU-T) Recommendation T.30. The NUC 21 closes and releases a telephone line L. In addition, the NCU 21 includes a function for transmitting a dial signal corresponding to a telephone number of a receiver, and a function for detecting an incoming call.

Next, a configuration of the printing unit 15 will be described in detail in accordance with a printing process. As shown in FIG. 1, a photoconductive drum 30 is rotatable on its axis, and a photoconductive film 31 is formed around a circumferential surface of the photoconductive drum 30.

A charger 40 is a brush roller implanted with conductive brushes. The charger 40 charges the photoconductive film 31 of the photoconductive drum 30 uniformly to a prescribed electric potential. An exposure unit 50 includes Light-Emitting Diode (LED) array 51. The exposure unit 50 forms an electrostatic latent image by exposing the photoconductive film 31 of the photoconductive drum 30 in accordance with the image data decoded by the codec 19.

A developing unit 60 includes a toner case 61, a supplying roller 62, and a developing roller 63. Further, the toner case 61 stores toner. The supplying roller 62 is provided in a lower part of the toner case 61, and is applied with a prescribed voltage. The developing roller 63 is located between the supplying roller 61 and the photoconductive drum 30, and provided at an opening at a lower end of the toner case 61. In addition, the developing roller 63 is applied with a prescribed voltage.

The toner is transported from the toner case 61 by the supplying roller 62 and the developing roller 63, and is applied with a prescribed electric potential. The toner is adhered selectively to the electrostatic latent image according to a difference between the applied electric potential and the electric potential of the electrostatic latent image that is formed on the photoconductive drum 30. A toner image is formed on the photoconductive drum 30 by the toner adhered to the electrostatic latent image.

Within the toner case 61, an agitator 64 is rotatable on its axis. By the rotation of the stirrer 64, the toner in the toner case 61 is always agitated, and the toner density is maintained uniformly.

Within a recording paper cassette 70, recording papers 71 in a prescribed size are stacked and stored. An electronic solenoid 72 connects and disconnects a rotational drive force of a motor 73 to a semi-circle like roller 74 (half-moon roller 74). The semi-circle roller 74 is attached to a rotating shaft 75. The semi-circle roller 74 sends out the uppermost sheet of the recording papers 71 that are stored in the recording paper cassette 70, one by one. Then, the sent out recording paper 71 is transported towards the photoconductive drum 30.

A first recording paper sensor 81 detects the recording paper 71 transported to a position directly in front of the developing unit 60. Further, a dashed line P shows a transporting path of the recording paper 71.

A transfer unit 90 is provided below the photoconductive drum 30, and is controlled under a prescribed electric potential. The transfer unit 90 transfers the toner image on the photoconductive drum 30 to the recording paper 71 by a difference between the electric potential of the transfer unit 90 and the electric potential of the toner image.

A memory removing brush 91 is an electrical conductive brush. The memory removing brush 91 scatters the toner remaining on the photoconductive drum 30, and the toner is distributed uniformly on the photoconductive drum 30.

A heat fuser 100 is provided to a side where the recording paper is sent out from the photoconductive drum 30. The heat fuser 100 includes a heating roller 101 and a pressuring roller 102, and the rollers 101, 102 are in contact with each other. The recording paper 71 is sent between the heating roller 101 and the pressuring roller 102, the toner image on the recording paper 71 is heated and fused. In other words, a heater H (refer to FIG. 2) is provided within the heating roller 101. The heater H is a halogen lamp or the like.

Further, according to the present embodiment, a series of processes as described above, in other words, discharging, exposing, developing to the photoconductive drum 30, and transferring, heat fusing to the recording paper 71, is one unit of the recording process.

A second recording paper sensor 82 shown in FIG. 1 is provided to a side where the recording paper is sent out from the heat fuser 100. The second recording paper sensor 82 detects that the recording paper 71 passed through the heat fuser 100. The MPU 11 determines the fact that a jam occurred within a recording process, when the second recording paper sensor 82 does not detect the recording paper 71 within a prescribed period of time after the first recording paper sensor 81 detected the recording paper 71.

A control unit 110 controls an operation of the printing unit 15 in accordance with a control signal from the MPU 11. In other words, the control unit 110 transmits a control signal for connecting and disconnecting the motor 73 and the semi-circle roller 74 to the electronic solenoid 72. Meanwhile, the first recording paper sensor 81 and the second recording paper sensor 82 transmit a detection signal indicating an arrival of the recording paper 71 to the control unit 110. Moreover, the control unit 110 carries out an energization control to the heater H of the heat fuser 100 in accordance with a control signal from the MPU 11.

Figure 2:
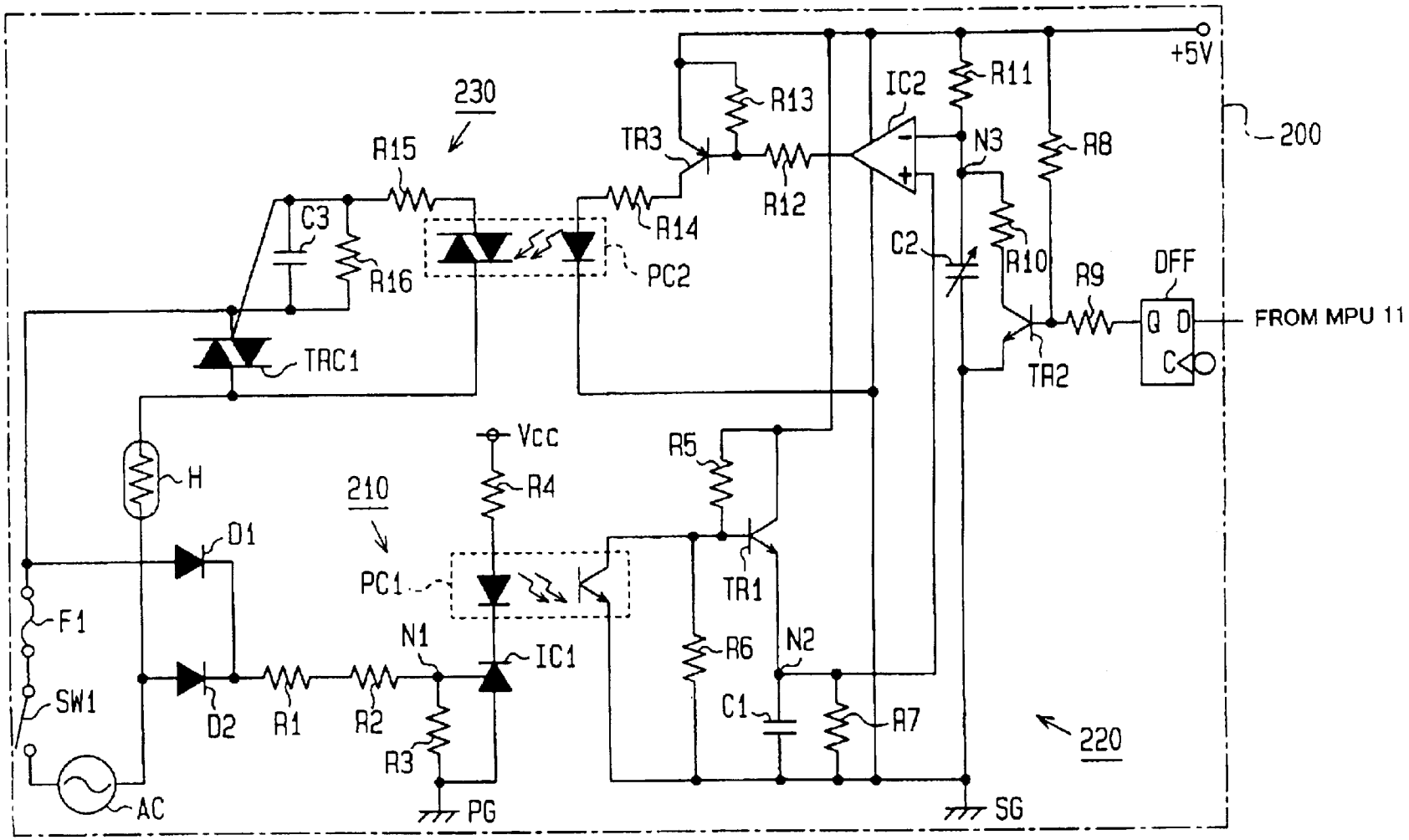
FIG. 2 is an electric circuit diagram showing a configuration of a heater energization control circuit.
Figures 3A, 3B, 3C, 3D:
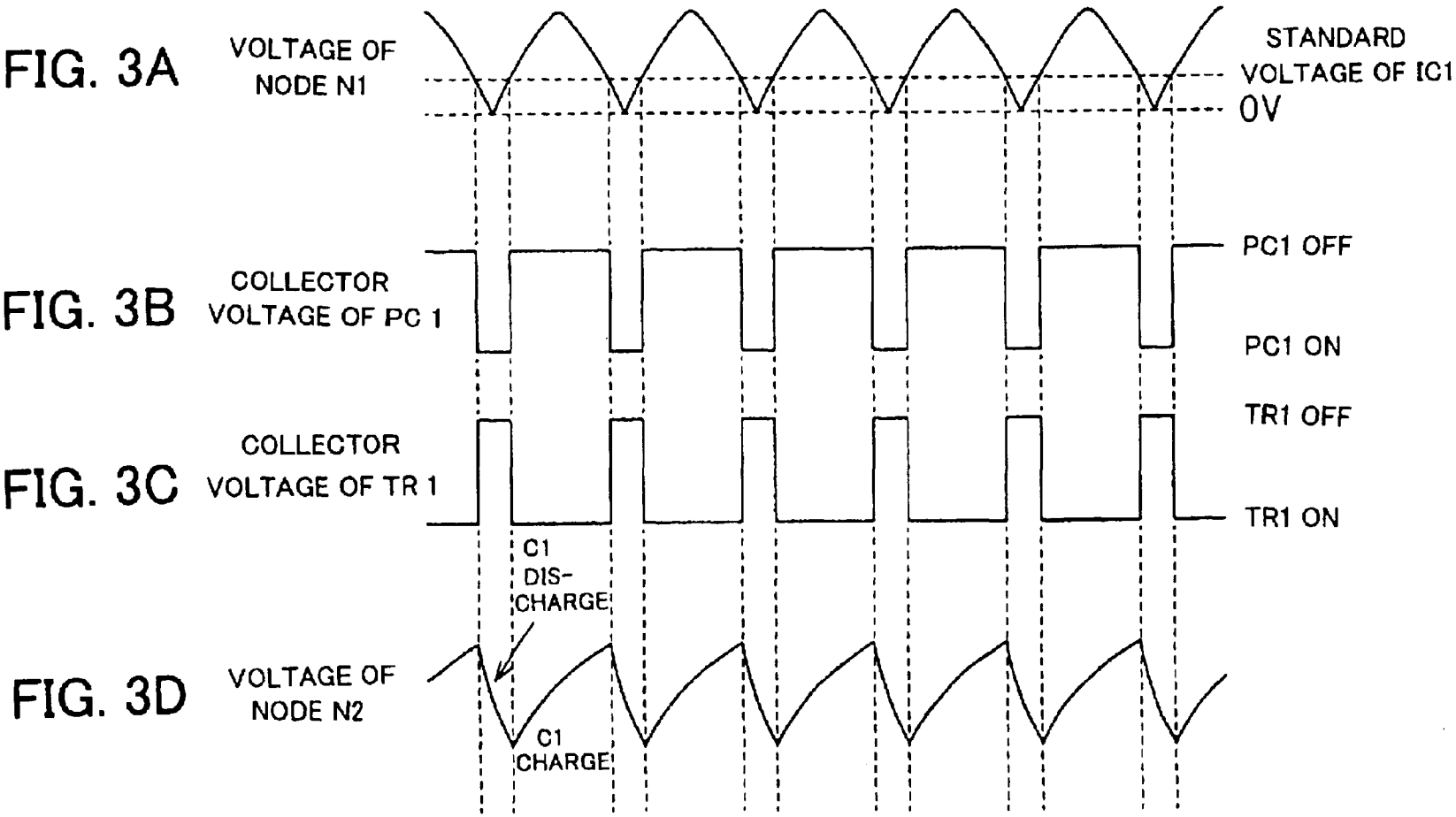
FIGS. 3A through 3D are time charts showing an operation of when a capacitor is charged and discharged.

Next, a configuration of the heater energization control circuit that controls the energization to the heater H of the heat fuser 100 will be described with reference to the electric circuit diagram shown in FIG. 2. As shown in FIG. 2, the heater energization control circuit 200 includes a zero crossing detecting circuit 210, an energization timing determining circuit 220, and a heater driving circuit 230.

The zero crossing detecting circuit 210 includes diodes D1, D2, resistors R1 through R4, three terminals regulator IC1, and a photo coupler PC1. The diodes D1, D2 carry out a full-wave rectification to the alternating current input from a commercial power source AC via a power switch SW1 and a fuse F1. The resistors R1 through R3 divide the voltage that is full-wave rectified by the diodes D1, D2.

When the voltage of a node N1 is less than a standard voltage of the three terminals regulator IC1, a voltage that is higher than the ON voltage of the photo coupler PC1 is applied to both ends of the LED of the photo coupler PC1, and an electric current flows through the LED. Therefore, the photo coupler PC1 is turned ON.

Meanwhile, when the voltage of node N1 is equal to or larger than the standard voltage of the three terminals regulator IC1, a voltage that is lower than the ON voltage of the photo coupler PC1 is applied to both ends of the LED of the photo coupler PC1, and only a small amount of electric current flows through the LED. Therefore, the photo coupler PC1 is put OFF.

The energization timing determining circuit 220 includes a transistor TR1, a capacitor C1, resistors R5 through R7, and a comparator IC2. When the photo coupler PC1 of the zero crossing detecting circuit 210 is ON, a collector electric current of the photo coupler PC1 flows from a constant voltage power source "+5V" to a ground "SG" via the resistor R5.

As a result, a voltage that is lower than the ON voltage of the transistor TR1 is applied between a base and an emitter of the transistor TR1, and a base electric current flows only minutely. Therefore, the transistor TR1 is turned OFF. Meanwhile, when the photo coupler PC1 is OFF, an electric current flows from the constant voltage power source "+5V" to the ground "SG" via the resistors R5, R6.

As a result, a voltage that is divided by the resistor R5 and the resistor R6, in other words, a voltage that is higher than the ON voltage of the transistor TR1, is applied between the base and the emitter of the transistor TR1, and the base electric current flows. Therefore, the transistor TR1 is turned ON. The capacitor C1 is charged when the transistor TR1 is ON, and is discharged when the transistor TR1 is OFF, in accordance with a first time constant that is determined by the electrostatic capacitance of the capacitor C1 and the resistance value of the resistor R7. The voltage of the capacitor C1, in other words, the voltage at node N2, is input to the non-inverting input terminal of the comparator IC2.

Moreover, the energization timing determining circuit 220 includes a D flip-flop DFF, transistors TR2, TR3, a variable capacitor C2, and resistors R8 through R14. When a control signal of H level (L level) is input to the D terminal of the D flip-flop DFF from the MPU 11 shown in FIG. 1, the D flip-flop DFF outputs a signal of H level (L level) from the Q terminal in synchronism with a falling of a clock signal.

When the signal of H level is output from the Q terminal of the D flip-flop DFF, a voltage that is higher than the ON voltage of the transistor TR2 is applied between the base and the emitter of the transistor TR2, and the base electric current flows. Therefore, the transistor TR2 is turned ON. Meanwhile, when the signal of L level is output from the Q terminal of the D flip-flop DFF, a voltage that is lower than the ON voltage of the transistor TR2 is applied between the base and the emitter of the transistor TR2, and the base electric current flows only minutely. Therefore, the transistor TR2 is turned OFF.

The variable capacitor C2 is discharged when the transistor TR2 is ON, and is charged when the transistor TR2 is OFF, in accordance with a second time constant that is determined by the electrostatic capacity of the variable capacitor C2 and the resistance value of the resistor R11. The voltage of the variable capacitor C2, in other words, the voltage at node N3, is input to the inverting input terminal of the comparator IC2.

Further, the second time constant that is determined by the electrostatic capacity of the variable capacitor C2 and the resistance value of the resistor R11 is set sufficiently larger than the first time constant that is determined by the electrostatic capacitance of the capacitor C1 and the resistance value of the resistor R7.

The comparator IC2 determines a timing to energize the heater H in accordance with the size relationship between the voltage of the capacitor C1 and the voltage of the variable capacitor C2, in other words, the size relationship between the voltage at node N2 and the voltage at node N3. That is, when the voltage at node N2 is less than the voltage at node N3, the comparator IC2 outputs the signal of L level. When the voltage at node N3 is equal to or larger than the voltage at node N3, the comparator IC2 outputs the signal of H level.

When the signal of L level is output from an output terminal of the comparator IC2, a voltage that is higher than the ON voltage of the transistor TR3 is applied between the emitter and the base of the transistor TR3, and the base electric current flows. Therefore, the transistor TR3 is turned ON. Meanwhile, when the signal of H level is input from the output terminal of the comparator IC2, a voltage that is lower than the ON voltage of the transistor TR3 is applied between the emitter and the base of the transistor TR3, and the base electric current flows only minutely. Therefore, the transistor TR3 is turned OFF.

The heater driving circuit 230 includes a photo coupler PC2, a triac TRC1, resistors R15, R16, and a capacitor C3. When the transistor TR3 of the energization timing determining circuit 220 is ON, the collector electric current of the transistor TR3 flows from the constant voltage power source "+5V" via the resistor R14 and the LED of the photo coupler PC2 to the ground "SG". Therefore, the photo coupler PC2 is turned ON.

Meanwhile, when the transistor TR3 is OFF, the electric current does not flow through the LED of the photo coupler PC2. Therefore, the photo coupler PC2 is turned OFF. When the photo coupler PC2 is ON, a voltage that is higher than the ON voltage of the triac TRC1 is applied to the gate of the triac TRC1, and the gate electric current flows. Therefore, the triac TRC1 is turned ON, and the energization from the commercial power source AC to the heater H is permitted.

Meanwhile, when the photo coupler PC2 is OFF, the electric current does not flow through the gate of the triac TRC1. Therefore, the triac TRC1 is turned OFF, and the energization from the commercial power source AC to the heater H is shut off.

Next, an operation of when the capacitor C1 is charged and discharged will be described with reference to the electric circuit diagram shown in FIG. 2, and the time charts shown in FIGS. 3A through 3D.

When the power switch SW1 is switched ON by a user, the alternating current from the commercial power source AC is full-wave rectified by the diodes D1, D2. Then, the full-wave rectified voltage is divided by the resistors R1 through R3 (refer to FIG. 3A).

When the voltage at node N1 is less than the standard voltage of the three terminals regulator IC1, the photo coupler PC1 is turned ON. When the voltage at node N1 is equal to or larger than the standard voltage of the three terminals regulator IC1, the photo coupler PC1 is turned OFF (refer to FIG. 3B). In other words, based on the fact that the photo coupler PC1 is turned ON, a vicinity of a zero crossing of the alternating current is detected. Therefore, the collector voltage of the photo coupler PC1 corresponds to the zero crossing detection signal.

Further, it is preferable to detect the timing that is close to the zero crossing as much as possible by the photo coupler PC1, by using the three terminals regulator IC1 which the standard voltage is as small as possible.

When the photo coupler PC1 is ON, the transistor TR1 is turned OFF. When the photo coupler PC1 is OFF, the transistor TR1 is turned ON (refer to FIG. 3C). As a result, when the transistor TR1 is ON, the capacitor C1 is charged, and when the transistor TR1 is OFF, the capacitor C1 is discharged (refer to FIG. 3D).

Next, an operation of when the variable capacitor C2 is charged and discharged will be described with reference to the electric circuit diagram shown in FIG. 2, and the time charts shown in FIGS. 4A through 4E.

Figures 4A, 4B, 4C, 4D, 4E:
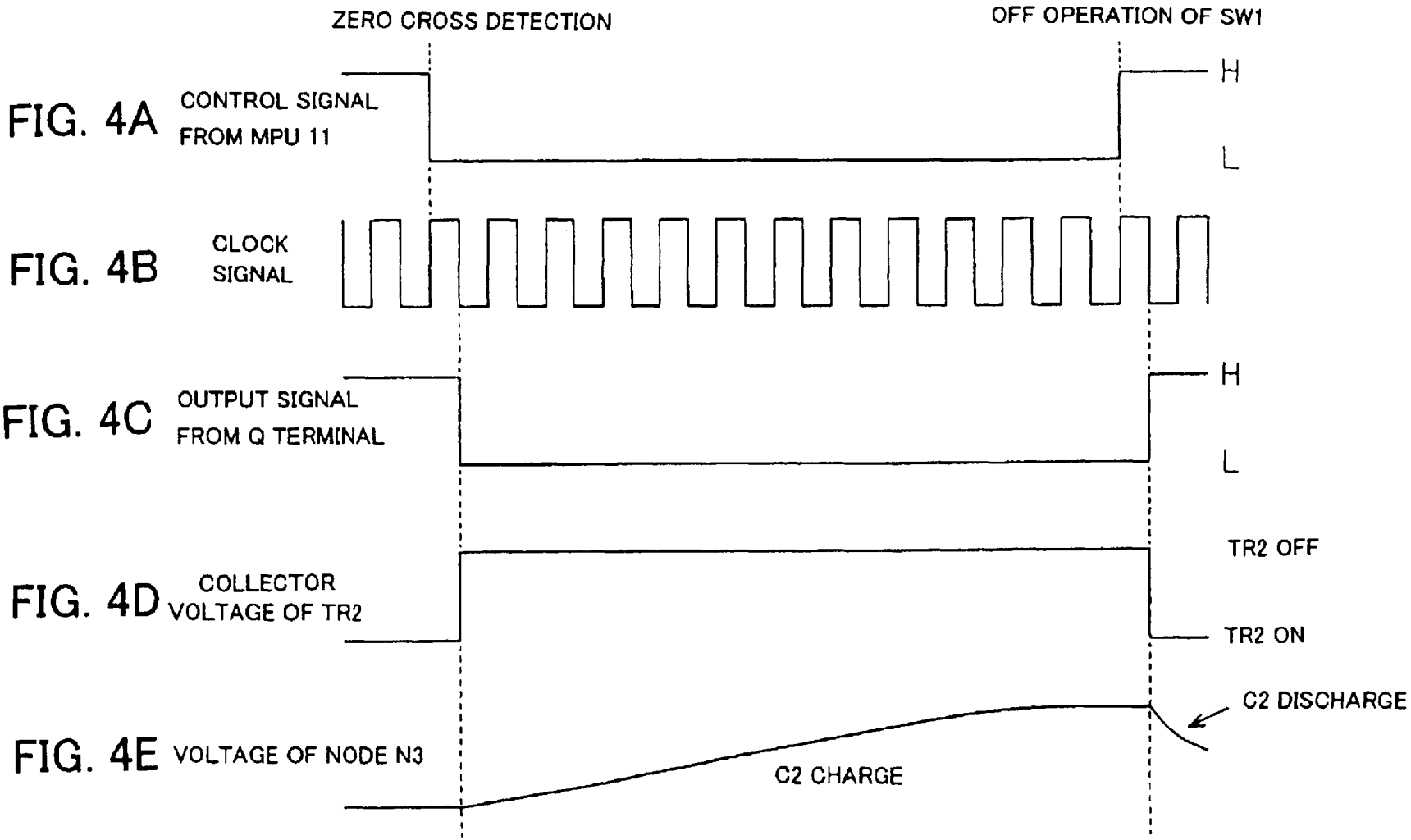
FIGS. 4A through 4E are time charts showing an operation of when a variable capacitor is charged and discharged.

When the power switch SW1 is switched ON by the user, the control signal of L level is input to the D terminal of the D flip-flop DFF from the MPU 11 in accordance with the zero crossing detection signal (refer to FIG. 4A). Further, when permitting the energization to the heater H of the heat fuser 100, the control signal of L level is input to the D terminal of the D flip-flop DFF from the MPU 11.

Meanwhile, when shutting the energization to the heater H, the control signal of H level is input to the D terminal of the D flip-flop DFF from the MPU 11. In other words, to save energy in the MFP 1, or to maintain the fusing temperature under almost constant temperature, when permitting or shutting the energization to the heater H, the control signal of L level or H level is input to the D terminal of the D flip-flop DFF from the MPU 11 when necessary.

When the control signal of L level is input to the D terminal of the D flip-flop DFF, the signal of L level is output from the Q terminal in synchronism with the fall of the clock signal. Meanwhile, when the control signal of H level is input to the D terminal of the D flip-flop DFF, the signal of H level is output from the Q terminal in synchronism with the fall of the clock signal (refer to FIGS. 4B, 4C).

When the signal of L level is output from the Q terminal of the D flip-flop DFF, the transistor TR2 is turned OFF. When the signal of H level is output, the transistor TR2 is turned ON (refer to FIG. 4D). As a result, when the transistor TR2 is OFF, the variable capacitor C2 is charged. When the transistor TR2 is ON, the variable capacitor C2 is discharged (refer to FIG. 4E).

Next, an operation of when supplying an alternating current to the heater H will be described with reference to the electric circuit diagram shown in FIG. 2, and the time charts shown in FIGS. 5A through 5D.

Figures 5A, 5B, 5C, 5D:
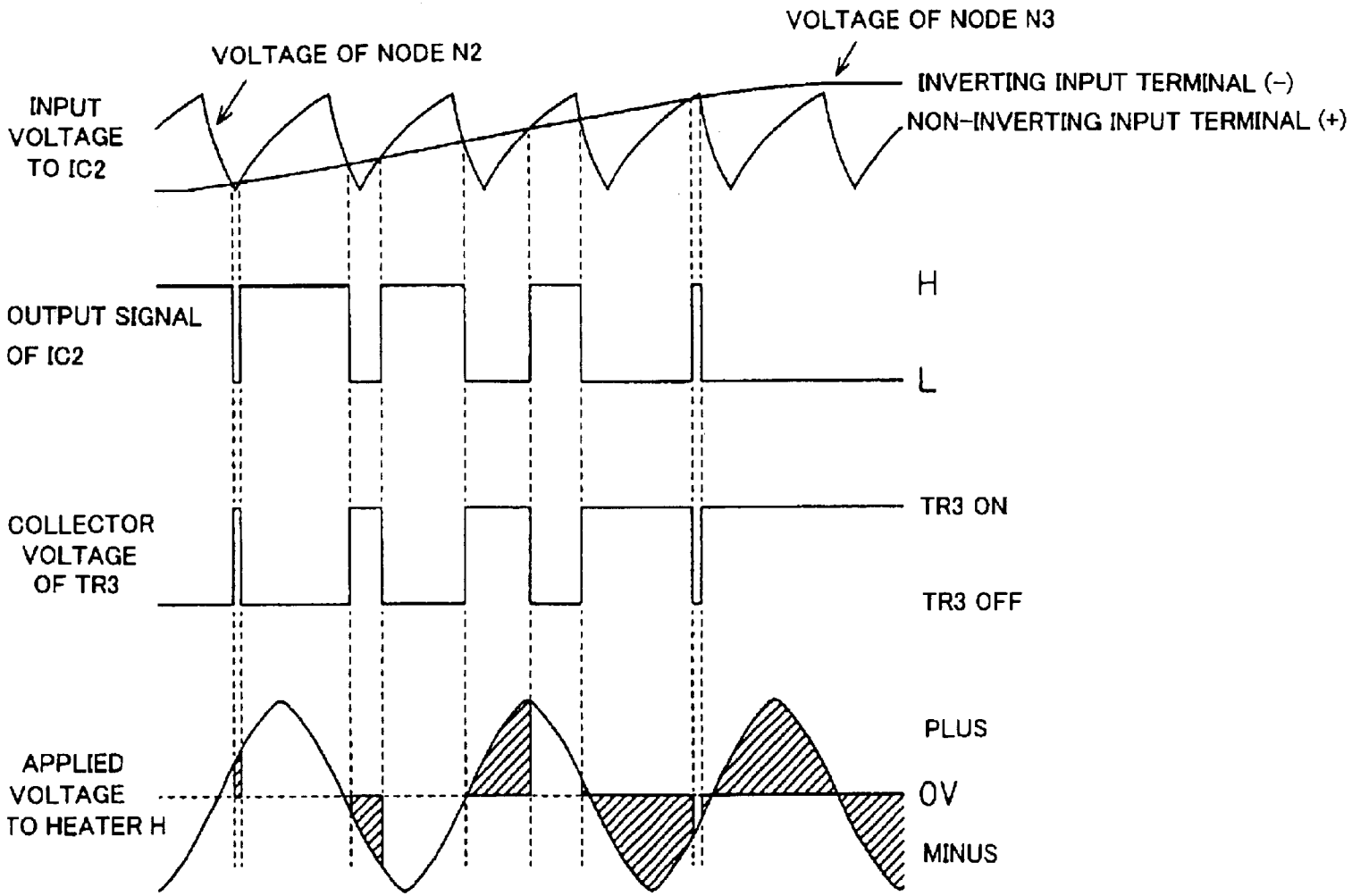
FIGS. 5A through 5D are time charts showing an operation of when a heater is applied with an alternating current.

The voltage at node N2 is input to the non-inverting input terminal of the comparator IC2, and the voltage at node N3 is input to the inverting input terminal at comparator IC2 (refer to FIG. 5A).

When the voltage at node N2 is less than the voltage at node N3, the signal of L level is output from the output terminal of the comparator IC2. When the voltage at node N2 is equal to or larger than the voltage at node N3, the signal of H level is output from the output terminal of the comparator IC2 (refer to FIG. 5B). Therefore, when the output signal of the comparator IC2 is L level, the transistor TR3 is turned ON. When the output signal of the comparator IC2 is H level, the transistor TR3 is turned OFF (refer to FIG. 5C).

As a result, when the transistor TR3 is ON, the photo coupler PC2 is turned ON, and the triac TRC1 is turned ON. When the transistor TR3 is OFF, the photo coupler PC2 is turned OFF, and the triac TRC1 is turned OFF.

Then, when the triac TRC1 is ON, the energization from the commercial power source AC to the heater H is permitted. When the triac TRC1 is OFF, the energization from the commercial power source AC to the heater H is shut off. That is, when the triac TRC1 is ON, in other words, only when the output signal of the comparator IC2 is L level, the alternating current is supplied to the heater H (refer to the shaded area in FIG. 5D). Therefore, the output signal of the comparator IC2 corresponds to the signal indicating the timing to energize the heater H.

Next, an action of the heater energization control circuit 200 will be described. The second time constant that is determined by the electrostatic capacity of the variable capacitor C2 and the resistance value of the resistor R11 is set sufficiently larger than the first time constant that is determined by the electrostatic capacity of the capacitor C1 and the resistance value of the resistor R7. Therefore, the variable capacitor C2 is charged and discharged for a cycle longer than a cycle when the capacitor C1 is charged and discharged. In other words, the first time constant is so small that the capacitor C1 is charged fully during a period when the transistor TR1 is ON, and the capacitor C1 is discharged almost completely during a period when the transistor TR1 is OFF (refer to FIGS. 3A, 3D, 5A).

Meanwhile, the second time constant is so large that the variable capacitor C2 is charged during a long period of time while the capacitor C1 is charged and discharged continuously (refer to FIGS. 4D, 4E, 5A). Further, to maintain the fusing temperature under almost constant temperature, when repeating the permitting and shutting off the energization to the heater H within a short cycle, the variable capacitor C2 starts charging before the discharge of the variable capacitor C2 is completed. Then, in accordance with a size relationship between the voltage at node N2 and the voltage at node N3, the signal indicating the energization timing for the heater H is output from the comparator IC2 (refer to FIG. 5B).

As a result, only when the output signal of the comparator IC2 is L level, an alternating current is supplied to the heater H. Specifically, from when the power switch SW1 is switched ON until the variable capacitor C2 is fully charged, the alternating current, which the energization period becomes long gradually for each half cycle, is supplied to the heater H intermittently.

In other words, an alternating current, which an amplitude increases gradually for each half cycle, is supplied to the heater H (refer to the shaded area in FIG. 5E). Then, after the variable capacitor C2 is fully charged, in other words, during a period when the voltage at node N3 exceeds the voltage at node N2 at all times, the alternating current is supplied to the heater H continuously (also refer to the shaded area in FIG. 5D).

As described above, according to the present embodiment, following actions and effects can be obtained.

(1) The second time constant that is determined by the electrostatic capacity of the variable capacitor C2 and the resistance value of the resistor R11 is set sufficiently larger than the first time constant that is determined by the electrostatic capacity of the capacitor C1 and the resistance value of the resistor R7. Therefore, the variable capacitor C2 is charged and discharged over a cycle that is longer than a cycle when the capacitor C1 is charged and discharged. Moreover, the comparator IC2 determines the timing to energize the heater in accordance with the size relationship between the voltage of the capacitor C1 and the voltage of the variable capacitor C2, in other words, the size relationship between the voltage at node N2 and the voltage at node N3.

As a result, the triac TRC1 permits that the alternating current is supplied to the heater H under an energization timing that is determined by the comparator IC2. That is, from when the power switch SW1 is switched ON and until the variable capacitor C2 is fully charged, in other words, directly after when the energization to the heater H is started, the alternating current is supplied intermittently to the heater H. Therefore, the incoming electric current flowing into the heater H of the heat fuser 100 can be prevented.

(2) From when the power switch SW1 is switched ON until the variable capacitor C2 is fully charged, the alternating current which the energization period becomes gradually long for each half cycle, is supplied intermittently to the heater H. In other words, from when the power switch SW1 is switched ON until the variable capacitor C2 is fully charged, the alternating current which the amplitude gradually becomes large for each half cycle, is supplied intermittently to the heater H. Then, after the variable capacitor C2 is charged fully, in other words, during a period when the voltage at node N2 exceeds the voltage at node N3 at all times, the alternating current is supplied continuously to the heater H.

That is, the energizing way to the heater H is determined in accordance with the first time constant and the second time constant. In other words, the energizing way to the heater H is determined by hardware components such as the capacitor C1, the variable capacitor C2, the resistors R7, R11, and the comparator IC2 or the like. Therefore, comparing to a configuration wherein the energizing way to the heater H is determined by software components such as an energization control program performed by the MPU 11, a load applied to the heater energization control of the MPU 11 can be reduced.

(3) When the power switch SW1 is switched ON, the control signal of L level that permits the energization to the heater H is output to the D terminal of the D flip-flop DFF from the MPU 11 in accordance with the zero crossing detection signal.

As a result, since the energization to the heater H is started in synchronism with the zero crossing detection signal, the amplitude of the alternating current supplied to the heater H becomes small. Therefore, the incoming electric current flowing through the heater H can be suppressed as much as possible.

Further, the resistors R7, R11 or the capacitor C1 can be replaced with a variable resistor or a variable capacitor.

What is claimed is:

1. A heater energization control circuit comprising:

means for supplying an alternating current to a heater;

a first capacitor that charges and discharges in accordance with a first time constant that is determined by an electrostatic capacity of the first capacitor and a resistance value of a first resistor;

a second capacitor that charges and discharges in accordance with a second time constant that is determined by an electrostatic capacity of the second capacitor and a resistance value of a second resistor; and means for determining an energization start timing to the heater in accordance with a size relationship between a voltage of the first capacitor and a voltage of the second capacitor, and starting to supply the alternating current to the heater by the means for supplying under this timing.

2. The heater energization control circuit according to claim 1, wherein the means for determining starts an energization to the heater when the voltage of the second capacitor becomes larger than the voltage of the first capacitor.

3. The heater energization control circuit according to claim 1, wherein the means for determining determines a period to energize the heater in accordance with a size relationship between a voltage of the first capacitor and a voltage of the second capacitor.

4. The heater energization control circuit according to claim 1, wherein the means for determining energizes the heater during a period when the voltage of the second capacitor is larger than the voltage of the first capacitor.

5. The heater energization control circuit according to claim 1, wherein the means for determining is a comparator, and the voltage of the first capacitor is input to a non-inverting input terminal of the comparator and voltage of the second capacitor is input to an inverting input terminal.

6. The heater energization control circuit according to claim 1, further comprising means for detecting a zero crossing of the alternating current, and the first capacitor is discharged at a time of a zero crossing, and the first capacitor is charged at a time of a non-zero crossing.

7. The heater energization control circuit according to claim 1, wherein the second capacitor is charged when a power switch is on, and the second capacitor is discharged when the power switch is off.

8. The heater energization control circuit according to claim 1, wherein at least one of the first capacitor and the second capacitor is a variable capacitor.

9. The heater energization control circuit according to claim 1, wherein at least one of the first resistor and the second resistor is a variable resistor.

10. A heater energization control method comprising:

determining an energization start timing to a heater in accordance with a size relationship between a voltage of a first capacitor and a voltage of a second capacitor; and starting to supply an alternating current to the heater under the timing determined.

11. The heater energization control method according to claim 10, further comprising energizing to the heater when the voltage of the second capacitor becomes larger than the voltage of the first capacitor.

12. The heater energization control method according to claim 10, further comprising determining a period to energize the heater in accordance with a size relationship between a voltage of the first capacitor and a voltage of the second capacitor.

13. The heater energization control method according to claim 10, further comprising energizing the heater during a period when the voltage of the second capacitor is larger than the voltage of the first capacitor.

14. The heater energization control method according to claim 10, further comprising detecting a zero crossing of the alternating current, discharging the first capacitor at a time of a zero crossing, and charging the first capacitor at a time of a non-zero crossing.

15. The heater energization control method according to claim 10, further comprising charging the second capacitor when the power switch is on, and discharging the second capacitor when the power switch is off.

16. The heater energization control method according to claim 10, further comprising providing at least one of the first capacitor and the second capacitor as a variable capacitor.

17. The heater energization control method according to claim 10, further comprising providing at least one of the first resistor and the second resistor is a variable resistor.

18. An image forming apparatus comprising:

a heat fuser having a heater;

means for supplying an alternating current to the heater;

a first capacitor that charges and discharges in accordance with a first time constant that is determined by an electrostatic capacity of the first capacitor and a resistance value of a first resistor;

a second capacitor that charges and discharges in accordance with a second time constant that is determined by an electrostatic capacity of the second capacitor and a resistance value of a second resistor; and means for determining an energization start timing to the heater in accordance with a size relationship between a voltage of the first capacitor and a voltage of the second capacitor, and starting to supply an alternating current to the heater by the means for supplying under this timing.

19. The image forming apparatus according to claim 18, wherein the means for determining starts an energization to the heater when the voltage of the second capacitor becomes larger than the voltage of the first capacitor.

20. The image forming apparatus according to claim 18, wherein the means for determining determines a period to energize the heater in accordance with a size relationship between a voltage of the first capacitor and a voltage of the second capacitor.

21. The image forming apparatus according to claim 18, wherein the means for determining energizes the heater during a period when the voltage of the second capacitor is larger than the voltage of the first capacitor.

22. The image forming apparatus according to claim 18, wherein the means for determining is a comparator, and the voltage of the first capacitor is input to a non-inverting input terminal of the comparator and the voltage of the second capacitor is input to an inverting input terminal.

23. The image forming apparatus according to claim 18, further comprising means for detecting a zero crossing of an alternating current, and the first capacitor is discharged at a time of a zero crossing, and the first capacitor is charged at a time of a non-zero crossing.

24. The image forming apparatus according to claim 18, further comprising a power switch, and the second capacitor is charged when the power switch is on, and the second capacitor is discharged when the power switch is off.

25. The image forming apparatus according to claim 18, wherein at least one of the first capacitor and the second capacitor is a variable capacitor.

26. The image forming apparatus according to claim 18, wherein at least one of the first resistor and the second resistor is a variable resistor.

27. A heater energization control circuit comprising:

means for supplying an alternating current to a heater;

a first capacitor that charges and discharges in accordance with a first time constant that is determined by an electrostatic capacity of the first capacitor and a resistance value of a first resistor;

a second capacitor that charges and discharges in accordance with a second time constant that is determined by an electrostatic capacity of the second capacitor and a resistance value of a second resistor; and a controller that determines an energization start timing to the heater in accordance with a size relationship between a voltage of the first capacitor and a voltage of the second capacitor, and starting to supply the alternating current to the heater by the power source for supplying under this timing.

* * * * *